US005137062A

United States Patent [19]

Kuethe et al.

[11] Patent Number: 5,137,062

[45] Date of Patent: Aug. 11, 1992

[54] AUTO-TAMPING FUNNEL SYSTEM

[75] Inventors: David F. Kuethe; William J. Mezera, both of Madison, Wis.

[73] Assignee: Oscar Mayer Foods Corporation, Madison, Wis.

[21] Appl. No.: 652,720

[22] Filed: Feb. 8, 1991

[51] Int. Cl.[5] ..... B30B 15/06; B30B 15/16

[52] U.S. Cl. ..... 141/71; 100/229 A; 100/233; 141/73; 141/81; 53/527

[58] Field of Search ..... 141/71, 73, 80, 81; 100/295, 226, 229 A, 233; 53/527, 523, 438

[56] References Cited

U.S. PATENT DOCUMENTS

| | | | |
|---|---|---|---|
| 2,334,774 | 11/1943 | Jordan . | |
| 2,939,494 | 6/1960 | Haver . | |
| 3,088,499 | 5/1963 | Rieger . | |
| 3,386,372 | 6/1968 | Knipp . | |
| 3,554,120 | 1/1971 | Liberman et al. | 100/229 A |
| 3,700,386 | 10/1972 | Menacci . | |
| 4,235,165 | 11/1980 | Fenner et al. | 100/229 A |
| 4,424,740 | 1/1984 | Gwathney et al. | 100/229 A |
| 4,896,593 | 1/1990 | Slusser | 100/233 X |

FOREIGN PATENT DOCUMENTS

| | | | |
|---|---|---|---|
| 249822 | 1/1970 | U.S.S.R. | 100/233 |
| 1226908 | 3/1971 | United Kingdom | 100/233 |

*Primary Examiner*—Ernest G. Cusick
*Attorney, Agent, or Firm*—Joseph T. Harcarik

[57] ABSTRACT

An auto-tamping funnel system for tamping a product in a container includes a downwardly converging funnel having a bottom outlet disposed adjacent an open top of the tray and a side recess or cutout near the bottom outlet. A door is sized to fit closely in the bottom outlet and in the side recess and a mounting mechanism mounts the door for movement such as rotation between a tamping position where the bottom outlet is closed by the door and a receiving position where the side recess is substantially closed by the door and the bottom outlet is unobstructed. A moving mechanism moves the door between the tamping and the receiving positions. Preferably, the mounting mechanism includes a pivot axis for the door which is adjacent the bottom outlet and the bottom outlet and the recess of the funnel are rectangularly shaped. A pressure distributing mechanism also provides a maximum tamping pressure against the product, when the door is in the tamping position, at a location which is spaced from the pivot axis. Advantageously, a second funnel with an associated second door, a second mounting mechanism and a second moving mechanism is located adjacent the first-mentioned funnel.

17 Claims, 5 Drawing Sheets

AUTO-TAMPING FUNNEL SYSTEM

FIELD OF THE INVENTION

The present invention relates generally to funnel systems for loading a product into a container, and more particularly to such a system which automatically tamps a product once it is deposited into the container.

BACKGROUND OF THE INVENTION

Funnel systems are used in the art to direct a product to a container, such as a food product which has been weighed on an automatic weigher into a tray to be sealed. It is known that after the product is delivered through a funnel to the tray, the product may need to be tamped down into the tray prior to applying a seal around the top of the tray. As this tamping is done by hand at a location downstream from the location of the funnel, the funnel must be positioned with its bottom outlet slightly (e.g., about ¼th inch) above the tray so that the subsequent movement of the tray relative to the funnel does not cause the mound of the product delivered by the funnel to engage the end of the bottom outlet and be knocked onto the sealing area. However, this positioning of the bottom outlet above the tray allows some of the product to occasionally bounce or splash out of the tray onto the sealing area. The presence of any product on the sealing area is not only unsightly but it obviously also adversely affects any applied seal.

It is known in the art to provide food loading funnels with means to compact or otherwise mechanically interact with the product being fed. For example, in the Jordan U.S. Pat. No. 2,334,774, a press acts against the bottom of a funnel to form comminuted meat products into a rectangular block. The Haver U.S. Pat. No. 2,939,494 also shows a funnel with rotating shovels which fling material into a receiving bag.

However, none of these references address the problem of automatically tamping a product after it has been delivered from a funnel into a container.

Thus, there exists a need for improvements in tamping a product once it has been delivered from a funnel into a receiving container such as a tray or the like.

SUMMARY OF THE INVENTION

A goal of the present invention is to provide a new and improved system for tamping a product delivered from a funnel into a container, which system overcomes the problems which existed heretofore.

This goal is achieved in accordance with the present invention by providing an auto-tamping funnel system for tamping a product after the product has been delivered from the funnel into a container such as a tray having an open end. The system includes a downwardly converging funnel having a bottom outlet disposed adjacent the open top of the tray and a side recess such as a cutout which is similarly shaped to and adjacent the bottom outlet. A door is sized to fit closely in the bottom outlet and also to fit in the side recess or cutout. A mounting means is then provided for mounting the door for movement such as rotation between a tamping position where the bottom outlet is substantially closed by the door and a receiving position where the side recess or cutout is received by the door and the bottom outlet is substantially unobstructed. A moving means moves the door between the tamping and the receiving positions.

In a preferred embodiment of the invention, the mounting means includes a pivot axis for the door which is adjacent the bottom outlet. In addition, the bottom outlet and the cutout of the funnel are rectangularly shaped and the door is then similarly rectangularly shaped.

In the preferred embodiment, the funnel system includes a pressure distributing means for providing a maximum tamping pressure against the product at a location which is spaced from the pivot axis when the door is in the tamping position. In one preferred embodiment, the pressure distributing means is a tamping surface of the door which is centrally convexly shaped about an axis which is perpendicular to the pivot axis. In another embodiment, pressure distribution is achieved by movement of a distal edge of the door distant from the pivot axis downwardly below the level of the bottom outlet and below a proximal edge of the door adjacent the pivot axis. With this latter embodiment, the door is wedge shaped with its greatest thickness at the distal edge.

The door preferably includes a shaft along one side having a distal end and a proximal end. The mounting means then includes a hole in one sidewall of the bottom outlet in which the distal end of the shaft is rotatably received, a slot in an opposite sidewall of the bottom outlet in which the proximal end of the shaft is rotatably received, and a retainer means for retaining the proximal end of the shaft in the slot.

In the preferred embodiment, the moving means includes a lever arm attached to the door, a fluid actuator rotatably attached at one end to the lever arm and which is rotatably attached at an opposite end to a support, and a stop means for preventing any movement of the door beyond the receiving position. Conveniently, the stop means is a bar located between the bottom outlet and the cutout.

Advantageously, the present invention may further include a second funnel with an associated second door, a second mounting means, and a second moving means located adjacent the first-mentioned funnel. Further, the supports for the fluid actuators are respectively located on adjacent funnels.

It is an advantage of the present invention that an automatic system is provided for funneling a product to a tray and for automatically tamping or compacting the product in the tray.

It is also an advantage of the present invention that the product is prevented from reaching the sealing area of the tray, thus reducing incidents of missealing and unsightly seals.

It is a further advantage of the present invention that the funneling system is readily usable on an automated filling and conveying system for the trays.

Other features and advantages of the present invention are stated in or apparent from detailed descriptions of presently preferred embodiments of the invention found hereinbelow.

DETAILED DESCRIPTION OF THE PREFERRED EMBODIMENTS

Figure 1:
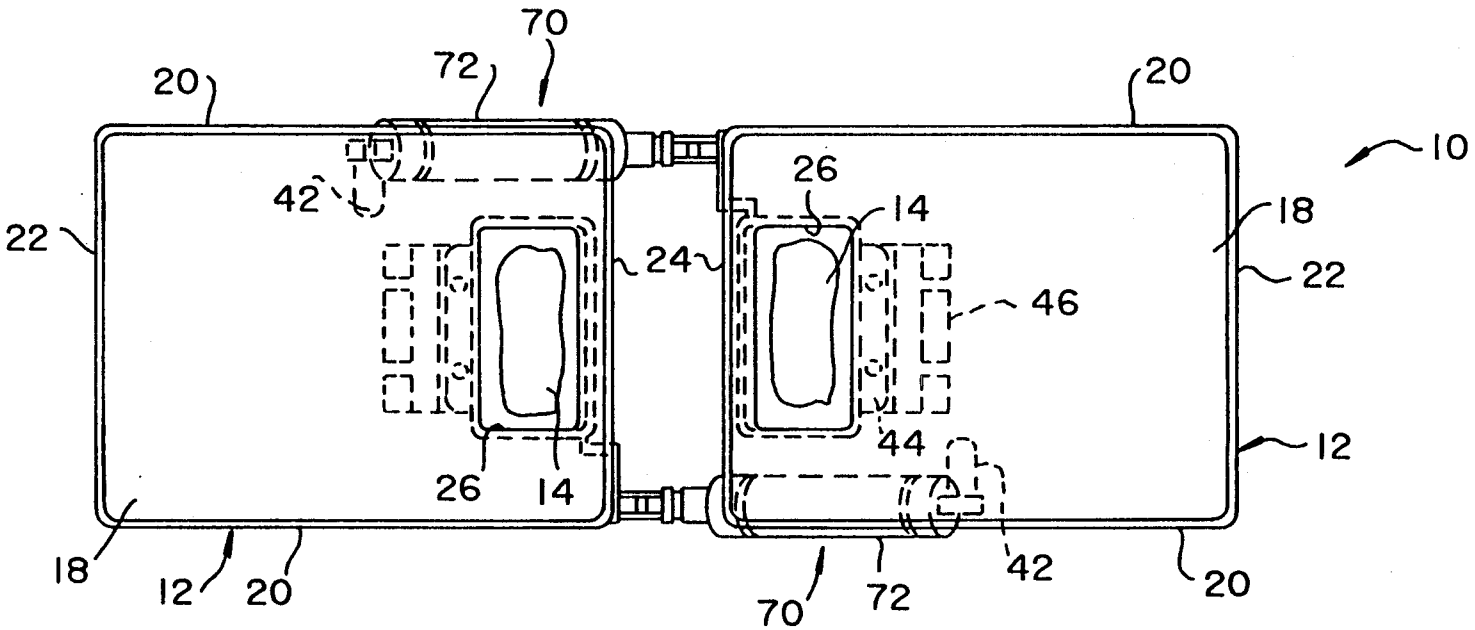
FIG. 1 is a top plan view of a funnel system according to the present invention.
Figure 3:
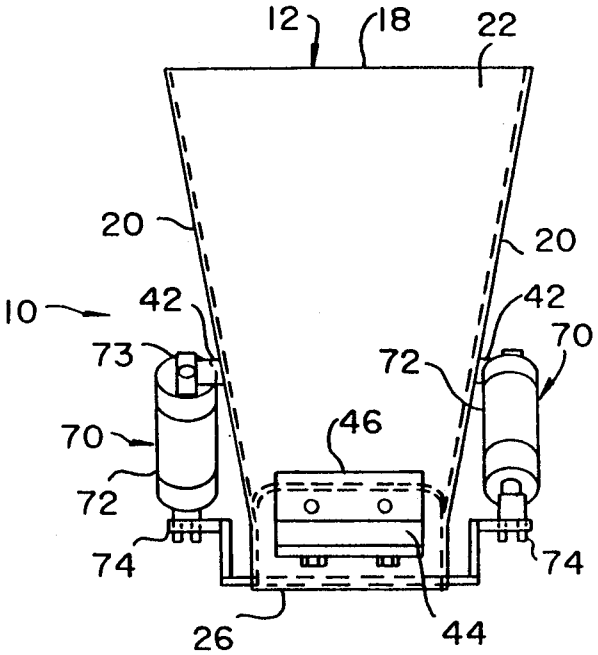
FIG. 3 is a right side view of the funnel system depicted in FIG. 1.
Figure 2:
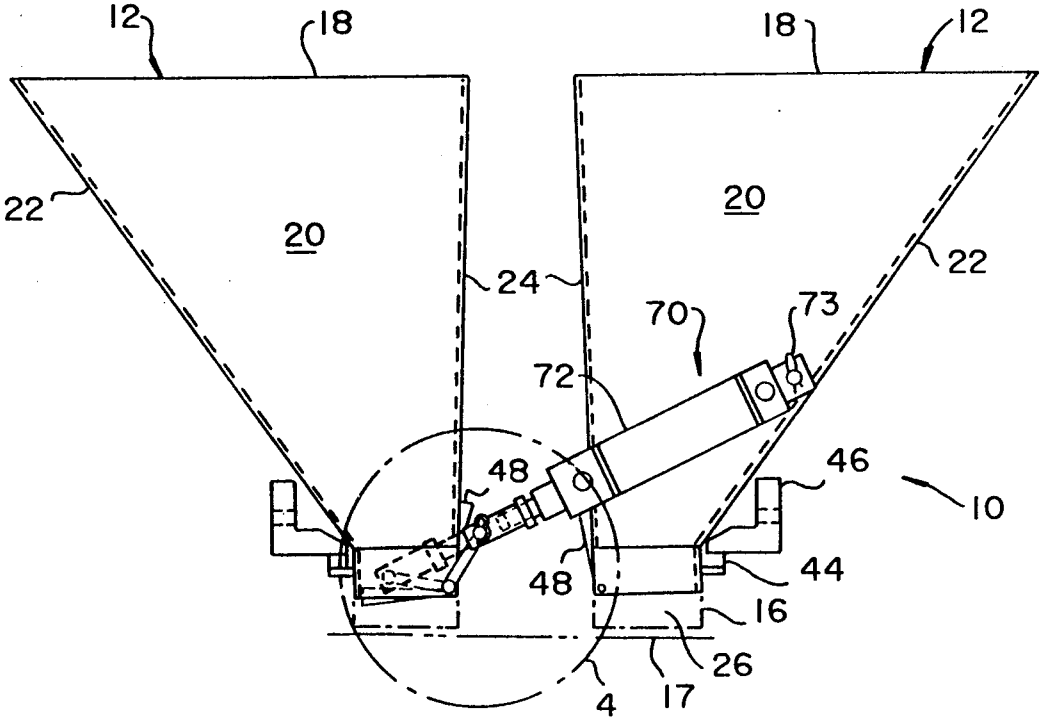
FIG. 2 is a front elevation view of the funnel system depicted in FIG. 1.

With reference now to the drawings in which like numerals represent like elements throughout the several views, an auto-tamping system 10 according to the present invention is depicted in FIGS. 1–3. In system 10, a pair of opposed funnels 12 have been depicted. It should be appreciated that each funnel 12 is designed to deposit a product 14 (shown only in FIG. 1 but omitted from the other figures for purposes of clarity) such as a semi-flowable surimi fish portion on the bottom of a suitable container such as a tray 16. Tray 16 also includes sides and a top surface surrounding these sides to which a sealant (not shown) such as a plastic film is subsequently glued to seal product 14 in tray 16. Such a tray with top surfaces and sealed with a plastic film is shown for example in Design Pat. No. D-305,204. Preferably, trays 16 are conveyed beneath the pair of funnels 12 by a suitable conveyor 17 which is part of an automatic filling and conveying system (not shown) and the pair of funnels 12 is moved over the top of and then with the properly positioned trays 16. Thereafter, the respective product 14 for each funnel 12 is then dropped therein. Preferably, there are two such sets of the pair of funnels 12, arranged side-by side, so that four properly positioned trays 16 can be filled at one time. However, the particular configuration of funnels 12 is not important to the present invention.

Figure 4:
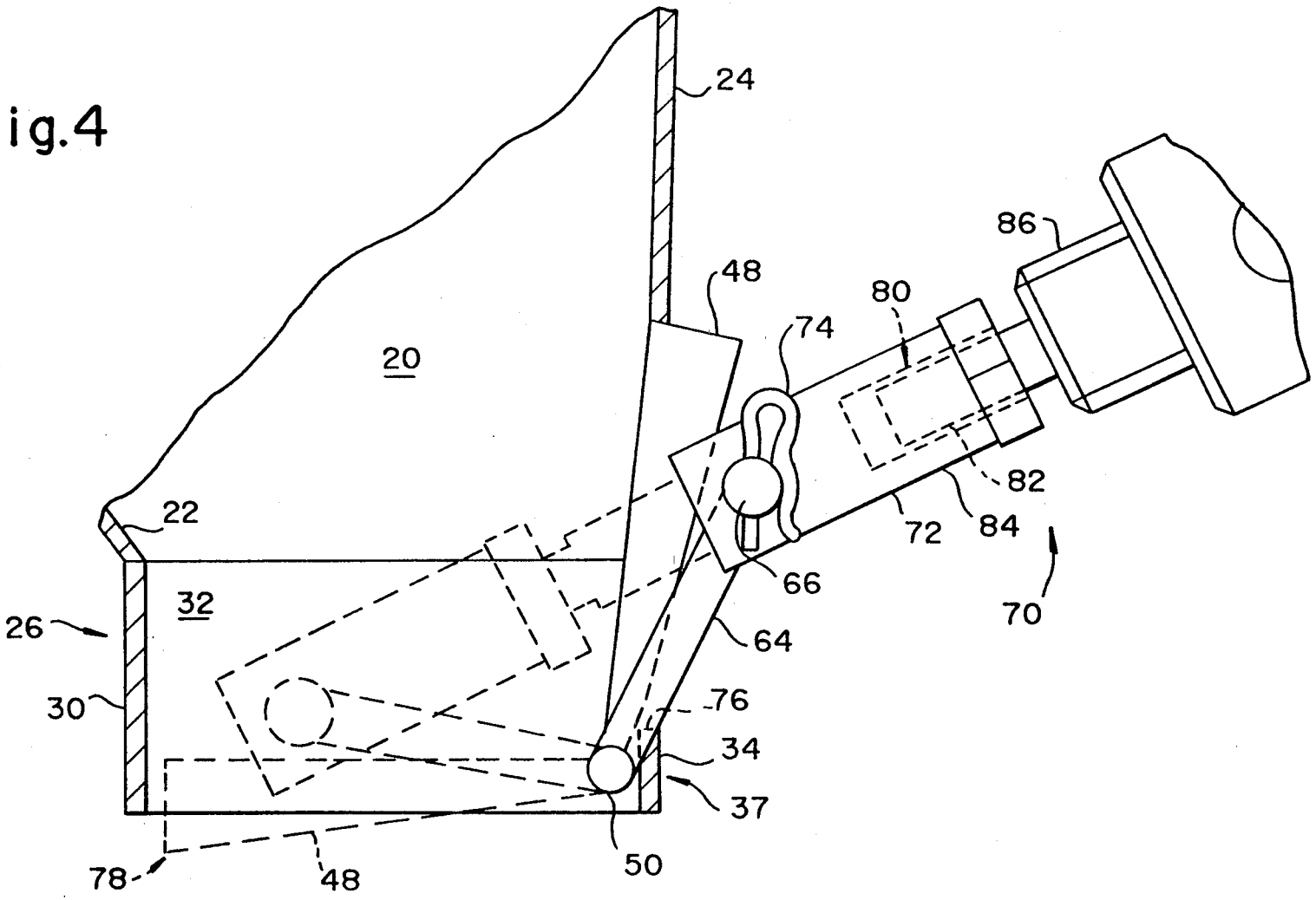
FIG. 4 is an enlarged front elevation view of the circled portion identified with the numeral 4 in FIG. 2 with some portions removed for clarity and showing the two positions of the door.
Figure 5:
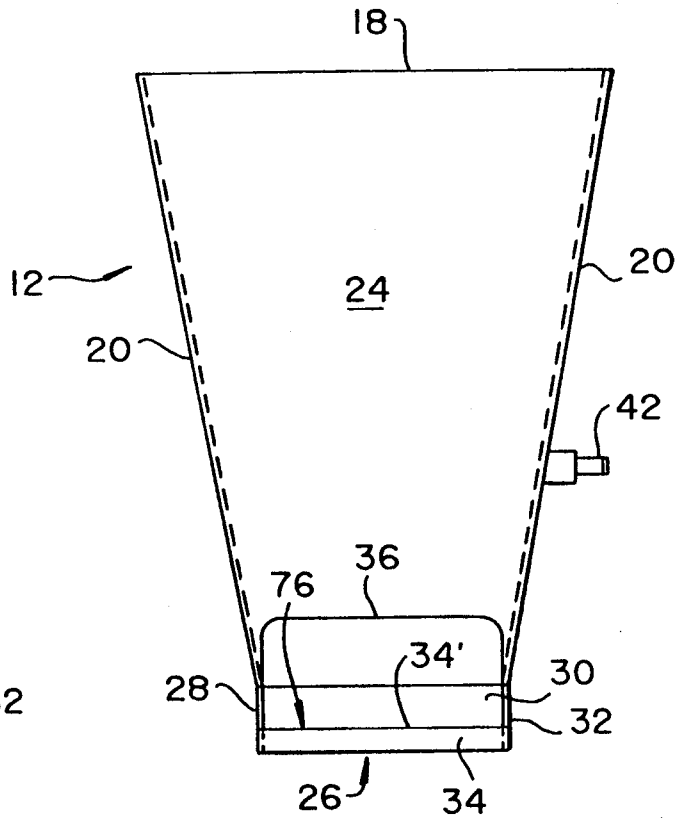
FIG. 5 is a side elevation view of a funnel as depicted in FIG. 1.
Figure 7:
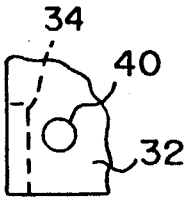
FIG. 7 is an enlarged right side elevation view of the bottom corner of the funnel depicted in FIG. 5.

As shown additionally in FIGS. 4 and 5, each funnel 12 includes an open top 18, lateral sides 20, a receiving side 22, and a facing side 24 which is almost vertical. Sides 20, 22, and 24 converge to a bottom outlet 26. Bottom outlet 26 is rectangular shaped in horizontal cross section with rounded corners as shown. Sidewalls 28, 30 and 32 define bottom outlet 26 on three sides, and a bar 34 bounds bottom outlet 26 on the last side. Provided above bar 34 and in facing side 24 is a recess which in this embodiment is an open area or cutout 36.

Figure 11:
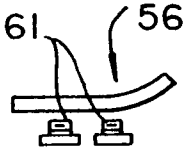
FIG. 11 is a bottom end view of the retainer piece depicted in FIG. 10.
Figure 8:
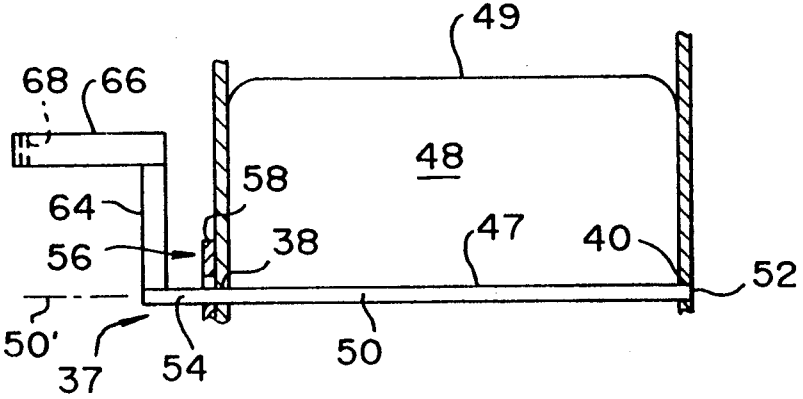
FIG. 8 is a front elevation view of the door depicted in FIGS. 1–4 according to the present invention.
Figure 10:
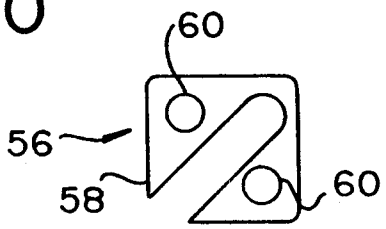
FIG. 10 is a left side elevation view of the retainer piece depicted in FIG. 8.
Figure 9:
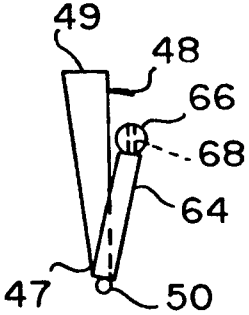
FIG. 9 is a left side elevation view of the door depicted in FIG. 8.

Provided for reciprocation by a mounting means 37 between bottom outlet 26 and cutout 36 is a wedge-shaped door 48. Door 48, as shown in greater detail in FIGS. 8–9, is shaped to fit closely in bottom outlet 26 as well in cutout 36 and thus is also rectangularly shaped. Attached along a proximal edge 47 of door 48 is a shaft 50 having a distal end 52 and a proximal end 54. Distal end 52 is received in a hole 40 of mounting means 37 provided in sidewall 32, while proximal end 54 is received in and extends through a slot 38 of mounting means 37 provided in sidewall 28. In order to retain proximal end 54 in slot 38, mounting means 37 also includes a retainer means 56. Retainer means 56 is a slotted retainer piece 58 which is suitably attached to sidewall 28 by screws 61 received through screw holes 60 in piece 58 and threaded holes 62 in sidewall 28. As shown in FIGS. 10 and 11, retainer piece 58 is curved at one side to match the curvature of the intersection of sidewall 28 and bar 34. Thus, it will be appreciated that shaft 50 is mounted in mounting means 37 and defines a pivot axis 50' about which door 48 pivots between bottom outlet 26 and cutout 36.

Attached to proximal end 54 is a lever arm 64 extending perpendicular thereto. Extending from lever arm 64 is a pin 66 having an aperture 68 therethrough. Lever arm 64 is used to move door 48 between bottom outlet 26 and cutout 36 by a moving means 70. Moving means 70 includes a fluid actuator 72 which is attached rotatably to mounting peg 42 by a suitable retainer clip 73 and at the other end to pin 66 by another retainer clip 74 received through aperture 68. Fluid actuator 72 is suitably controlled by machinery which moves funnels 12 as will be explained subsequently.

It will be appreciated that product 14 to be delivered to tray 16 is dropped approximately down the center of funnel 12, landing on receiving side 22 and then sliding down and out through bottom outlet 26. As this occurs, door 48 is kept in a receiving position by moving means 70. In particular, door 48 is received in cutout 36 as shown in solid lines in FIG. 4. In this position, the end of a distal edge 49 of door 48 is aligned with facing sidewall 24, so that door 48 smoothly extends facing side 24 and no impediment is presented to product 14. This receiving position is readily achieved by the precise positioning of a top 34' of bar 34 which consequently constitutes a stop means 76. It will thus be appreciated that moving means 70 simply moves pin 66 as far back as possible until door 48 stops against stop means 76.

Thereafter, after product 14 is delivered to tray 16, product 14 is typically in the form of a heap or mound. Moving means 70 is then actuated (by a suitable sensor or other electronic actuator) to move door 48 from the receiving position to the tamping position to tamp product 14 in tray 16. However, in order to spread product 14 evenly in tray 16, system 10 includes a pressure distributing means 78. Pressure distributing means 78 provides a maximum tamping pressure against product 14, when door 48 is in the tamping position, at a location which is spaced from pivot axis 50'. Employment of pressure distributing means 78 is used to counter the tendency of product 14 nearest shaft 50 (or pivot axis 50'), and hence the first to be contacted by door 48, to push the remainder of product 14 to the opposite end of tray 16 where this remainder is trapped and over-compressed. Pressure distributing means 78 is provided by adjusting the rotation of door 48 to be slightly beyond the end of bottom outlet 26 as shown in broken lines in FIG. 4. Thus, product 14 is not only pressed downwardly by door 48, but the slight over travel (beyond bottom outlet 26) compresses that portion of product 14 at the end of tray 16 being pushed there by the action of door 48 back to the remainder of tray 16 so that product 14 is thus evenly distributed in tray 16.

The amount of over travel of door 48 is adjustable by use of an adjusting means 80. Adjusting means 80 in this embodiment is a threaded connection 82 between a connector 84 in which pin 66 is received and arm 84 extending out of fluid actuator 72. It should also be appreciated that the wedge shape of door 48 assists in this pressing action. After this tamping action is completed, moving means 70 then returns door 48 to the receiving position.

As shown in FIGS. 1-3, sidewalls 30 include a respective mounting bracket 44 integrally fixed thereto to which a respective moving bracket 46 is attached. Moving brackets 46 are suitably attached by arms (not shown) to the automatic filling and conveying system which moves brackets 46 and hence funnels 12 in cycle along with successive trays 16 (or groups of trays 16) travelling thereby on conveyor 17 and in position for products 14 to be dropped into funnels 12 and be delivered to trays 16. As indicated above, moving means 70 then cause doors 48 to be moved from the receiving position to the tamping position where product 14 is tamped in tray 16 and evenly distributed therein. Thereafter, moving brackets 46 cycle funnels 12 back to a starting position to repeat the cycle. It should be appreciated that as part of this cycle, moving brackets 46 also move funnels 12 downwardly prior to the delivery of product 14 so that the bottoms of sidewalls 28, 30, and 32, and bar 34 are at the same level as the top surface of tray 16 or just below (about 1/16th inch) the top surface. Consequently, there is no spillage or splashing of product 14 onto the top surface of tray 16 when product 14 is delivered by funnel 12 into tray 16 or when product 14 is tamped into place.

Figure 12:
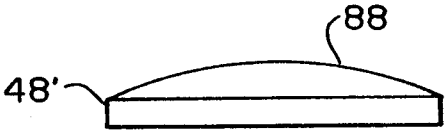
FIG. 12 is a top plan view of an alternative embodiment of a door according to the present invention.
Figure 6:
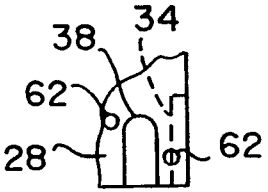
FIG. 6 is an enlarged left side elevation view of the bottom corner of the funnel depicted in FIG. 5.

Depicted in FIG. 12 is an alternative embodiment of a door 48'. Door 48' includes a plastic tamping surface 88 which is centrally convex shaped (about ¼th inch in height) about an axis which is perpendicular to pivot axis 50' as shown. This shape serves to tamp or spread product 14 evenly in tray 16 in a manner similar to wedge shaped door 48 described above.

While the present invention has been described with respect to exemplary embodiments thereof, it will be understood by those of ordinary skill in the art that variations and modifications can be effected within the scope and spirit of the invention.

We claim:

1. An auto-tamping funnel system for tamping a product in a container having a bottom wall, a side enclosure, and a vertically open top comprising:

a downwardly converging funnel having a vertically open bottom outlet disposed vertically adjacent the open top and above the bottom wall of the container and a side recess near said bottom outlet;

a door which is sized to fit closely in said bottom outlet and to fit in said side recess;

a mounting means for mounting said door for movement between a tamping position and a receiving position, such that in said tamping position said bottom outlet is substantially closed by said door as a bottom of said door engages and tamps down product, which has been delivered downwardly through said funnel directly onto said bottom wall, against said bottom wall and into said container, and such that in said receiving position said side recess receives said door and said bottom outlet is substantially unobstructed vertically; and a moving means for moving said door between said tamping and said receiving positions.

2. An auto-tamping funnel system as claimed in claim 1 wherein said mounting means includes a pivot axis for said door which is immediately adjacent said bottom outlet.

3. An auto-tamping funnel system as claimed in claim 2 wherein said bottom outlet and said door are rectangularly and congruently shaped, and said recess of said funnel is similarly rectangularly shaped and is substantially completely closed by said door when said door is in the receiving position.

4. An auto-tamping funnel system as claimed in claim 3 wherein said recess is a cutout of a side wall of said funnel which said cutout is only slightly larger than said door such that said door is received completely therein and closes said cutout such that said door is coplanar with said side wall.

5. An auto-tamping funnel system as claimed in claim 4 and further including a pressure distributing means for providing a maximum tamping pressure against the product at a location which is spaced from said pivot axis when said door is in the tamping position.

6. An auto-tamping funnel; system as claimed in claim 5 wherein said pressure distributing means is a tamping surface of said door which is centrally convex shaped about an axis which is perpendicular to said pivot axis.

7. An auto-tamping funnel system as claimed in claim 5 wherein said pressure distributing means is a movement of a distal edge of said door distant from said pivot axis beyond said bottom outlet and below a proximal edge adjacent said pivot axis by said moving means.

8. An auto-tamping funnel system as claimed in claim 7 wherein said door is wedge shaped with a greatest thickness at said distal edge.

9. An auto-tamping funnel system as claimed in claim 5 wherein said door includes a shaft along one side having a distal end and a proximal end; and wherein said mounting means includes a hole in one sidewall of said bottom outlet in which said distal end of said shaft is rotatably received, a slot in an opposite sidewall of said bottom outlet in which said proximal end of said shaft is rotatably received, and a retainer means for retaining said proximal end of said shaft in said slot such that the movement of said door is rotational about said shaft.

10. An auto-tamping funnel system as claimed in claim 9 wherein said moving means includes a lever arm attached to said door, a fluid actuator rotatably attached at one end to said lever arm and which is rotatably attached at an opposite end to a support, and a stop means for preventing any movement of said door beyond said receiving position.

11. An auto-tamping funnel system as claimed in claim 10 wherein said stop means is a bar located between said bottom outlet and said cutout.

12. An auto-tamping funnel system as claimed in claim 10 and further including a second funnel provided with an associated second door, second mounting means, and second moving means located adjacent said first-mentioned funnel, and wherein said supports for said fluid actuators are respectively located on adjacent said funnels.

13. An auto-tamping funnel system as claimed in claim 1 and further including a pressure distributing means for providing a maximum tamping pressure against the product at a location which is spaced from said pivot axis when said door is in the tamping position.

14. An auto-tamping funnel system as claimed in claim 1 wherein said door includes a shaft along one side having a distal end and a proximal end; and wherein said mounting means includes a hole in one sidewall of said bottom outlet in which said distal end of said shaft is rotatably received, a slot in an opposite sidewall of said bottom outlet in which said proximal end of said shaft is rotatably received, and a retainer means for retaining said proximal end of said shaft in said slot such that the movement of said door is rotational about said shaft.

15. An auto-tamping funnel system as claimed in claim 14 wherein said recess is a cutout of a sidewall of said funnel.

16. An auto-tamping funnel system as claimed in claim 1 wherein said moving means includes a lever arm attached to said door, a fluid actuator rotatably attached at one end to said lever arm and which is rotatably attached at an opposite end to a support, and a stop means for preventing any movement of said door beyond said receiving position.

17. An auto-tamping funnel system as claimed in claim 16 and further including a second funnel provided with an associated second door, second mounting means, and second moving means located adjacent said first-mentioned funnel, and wherein said supports for said fluid actuators are respectively located on adjacent said funnels.

* * * * *